United States Patent [19]

Schumacher

[11] 4,080,077

[45] Mar. 21, 1978

[54] MULTICOLOR WRITING INSTRUMENT

[75] Inventor: Emil Schumacher, Birkenfeld near Pforzheim, Germany

[73] Assignee: Sarastro Kinzinger GmbH, Pforzheim, Germany

[21] Appl. No.: 697,871

[22] Filed: Jun. 21, 1976

Related U.S. Application Data

[63] Continuation-in-part of Ser. No. 587,858, Jun. 18, 1975, abandoned, which is a continuation-in-part of Ser. No. 491,660, Jul. 25, 1974, Pat. No. 3,910,705.

[30] Foreign Application Priority Data

Apr. 10, 1976 Germany ..... 2615810

[51] Int. Cl.[2] ..... B43K 27/14

[52] U.S. Cl. ..... 401/30; 401/32

[58] Field of Search ..... 401/29–33

[56] References Cited

U.S. PATENT DOCUMENTS 1,697,437 1/1929 Stout et al. ..... 401/30

1,981,917 11/1934 Kimura ..... 401/30

FOREIGN PATENT DOCUMENTS 589,077 2/1959 Italy ..... 401/32

*Primary Examiner*—Stephen C. Pellegrino

[57] ABSTRACT

A dual refill containing variable refill positioning writing instruments utilizing cam followers attached to two refill members and oppositely threaded spiral cam grooves within which said cam followers ride. The writing instrument includes an inner tubular shell having two spiral cam grooves each located substantially about one-half of the circumference of said shell and longitudinally displaced from each other and an outer tubular shell having two spiral cam grooves located around substantially one-half the circumference of the shell and longitudinally spaced from each other with each of the cam grooves corresponding with but oppositely threaded in respect to the inner shell spiral cam grooves. The inner shell nests within and is rotatable with respect to the outer shell.

6 Claims, 7 Drawing Figures

18
19
1
2
7
5a
9a
9
6
11
8a
9b
10
8
8b
13
5b
12
15
20
16
14
16

1
5a
2
4a
3a
3b
4b
5b 1
3a
3b
17
4a
4b
2

6,7
10,11
10,11

6,7
B
B
12,13
12,13

14, 15
16

4a
3a
1
3b
4b
2

MULTICOLOR WRITING INSTRUMENT

This invention relates to a multi-color writing instrument and is a continuation-in-part of co-pending U.S. application Ser. No. 587,858 filed June 18, 1975 (now abandoned) and is a further continuation-in-part of U.S. application Ser. No. 491,660 filed July 25, 1974, now issued as U.S. Pat. No. 3,910,705, all of the above continuation-in-part applications being in the name of the inventor. It should be noted that throughout the specification, where a reference is made to "application" it refers to the co-pending application only.

The color-changing two-color writing implement according to the above-mentioned application includes a camcontrolled extending and retracting mechanism in which two refill carriers cooperate with oppositely threaded, crossing helical cam grooves. The helical cam grooves consist of oppositely threaded helical slots and inner and outer tubular shells with one nested within the other; with the shells being rotatable relative to each other. The refill carriers engage the intersections of the cam grooves by means of cam followers attached thereto and, consequently, the cam followers and the points of intersection are shifted as the shells are rotated. The inner cam shell is rotatably suspended in the outer cam shell, the rear end section of the barrel of the writing instrument is carried by the projecting end of the inner shell, and the forward end section of the barrel is carried by the forward end of the outer shell. Each rear end portion of the refill carrier consists of a half-cylinder, preferably of plastic, which is guided in the inner shell and carries a pin which serves as the cam follower. The pin is fitted through the half-cylinder and extends through the intersection of the helical slots in the two cam sleeves.

In the above-mentioned application, the two rotatable sleeves are weakened in cross-section by the slots which extend substantially the entire length of both sides of each of the shells. Also, the follower ends of the refill carriers are not optimally designed for ease of manufacturing and maintaining the guiding of the refills and the positioning thereof during engagement and retraction.

In accordance with the present invention, these disadvantages are eliminated. To that end, the color-changing writing instrument, e.g., a ball point pen, is characterized by the utilization of a second pair of cams which cooperate with the first pair of cams and are rotatable relative therethrough through an arc of 180° and are offset from the first pair of cams in the longitudinal direction of the writing instrument so that an excessive weakening of the shells is avoided.

The rear end portions of the refill carriers each consist of a half-cylinder and are guided in the inner shell and provided with respective follower pins extending through the intersection of the helical slots of the two cam sleeves, which, as is the case in the prior co-pending application, are rotatable relative to each other. Each follower pin consists of a slidable curved pin disposed in a curved opening of the half-cylinders so that the manufacture and assembly are simple. This is particularly true in the case of refill carriers having equally designed rear ends whereby the curved pins may engage the cam grooves at their upper and lower intersection.

Each of the half-cylindrical ends of the refill carriers are provided with an inwardly protruding spring biased tongue, and these tongues slide on the ends of the opposite refill carriers so that the guided movement is accompanied by frictional contact sufficient for actuation of the positioning mechanism.

An embodiment of the writing instrument according to this invention is shown diagrammatically and by way of example in the drawings and further details will be described with reference to them in which.

Figures 1, 2, 3, 4, 5, 5A, 5B:
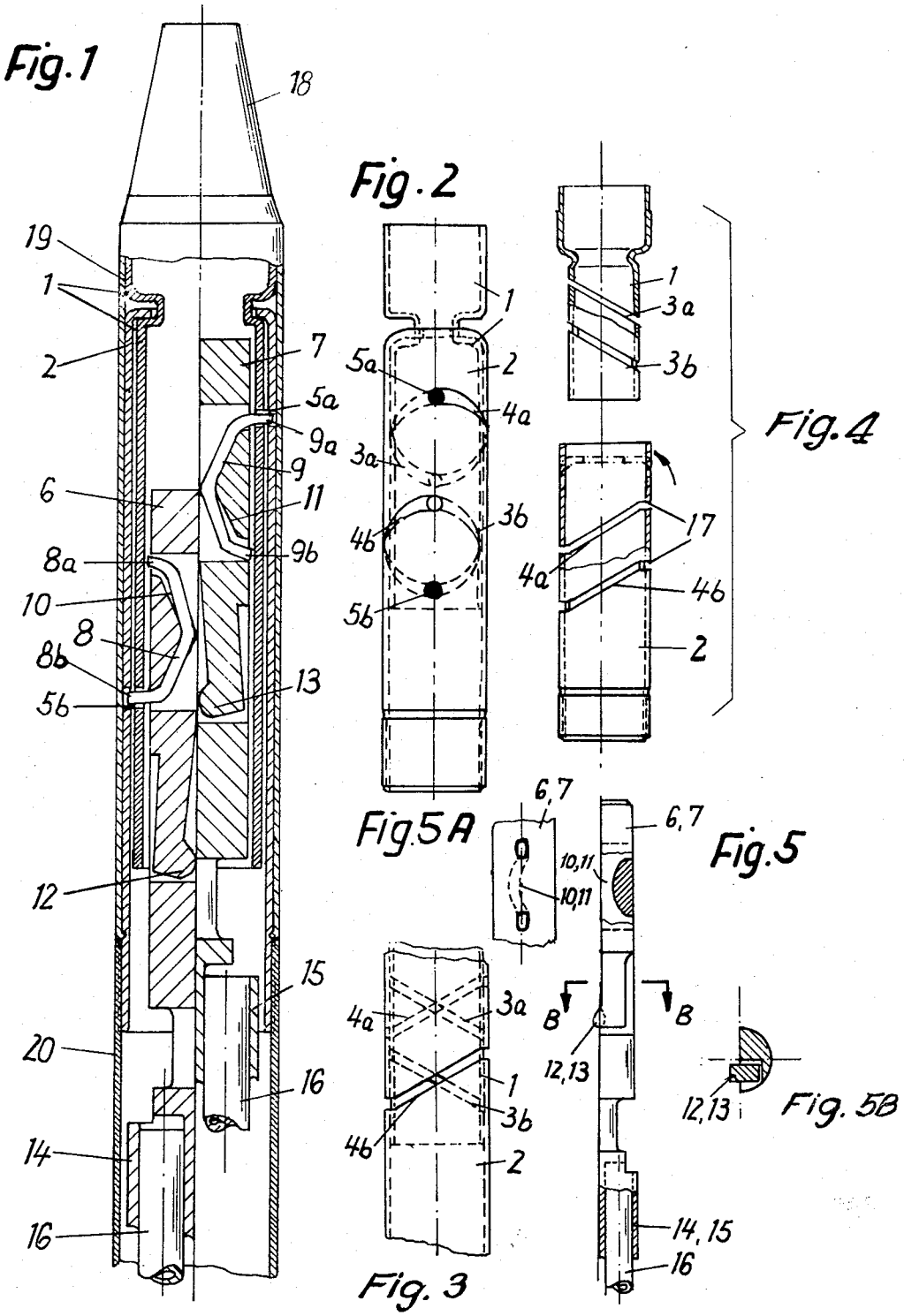
FIG. 1 is a central longitudinal sectional view showing a writing instrument in which one refill has been extended.
FIG. 2 is an elevation showing the two cam shells rotatable one within the other in the position illustrated at FIG. 1.
FIG. 3 is an elevation showing the two cam shells in a position of non-extension of both of the refills.
FIG. 4 shows the non-assembled cam shells with each shell in cross-section.
FIG. 5 is an elevation showing a refill carrier end portion and fragmentary sectional views A and B of the spring biased tongue.

The writing instrument comprises a cam-controlled extending and retracting mechanism and includes two cam shells 1 and 2 with the inner shell 1 rotatable in the outer shell 2. Shells 1 and 2 are provided with oppositely threaded helical slots 3 and 4, the intersections 5 of which move upwardly or downwardly as the shells are rotated.

As is apparent from FIGS. 2 and 3 of the drawings, the two cooperating pairs of cams of the oppositely threaded helical slots *3a*, *4a* and *3b*, *4b* are rotatable through an arc of approximately 180° relative to each other and are offset both horizontally and vertically along the writing instrument so that the weakening in cross-section of the two sleeves of the writing instrument as occurs with the above-mentioned copending application is avoided. It should also be noted that the threads are very shallow in their spiral pitch when compared with the prior art spiral grooves both as shown in the co-pending application and devices which are shown in prior art patents such as U.S. Pat. No. 1,697, Stout et al; U.S. Pat. No. 1,981,917, Kimura and U.S. Pat. No. 2,369,080, Schulman et al. It is also apparent from FIGS. 1 and 5 of the drawing that the two refill carriers have rear end portions which consist of half-cylinders 6 and 7 which are guided in the inner shell 1 and provided with follower pins 8 and 9 respectively. These pins extend through the inner section 5 of the helical slots 3 and 4 of the shells 1 and 2. Each follower pin 8 or 9 consists of a slidable curved pin, which is disposed in a curved opening 10 or 11. Each pin may engage the cam slots at an intersection *5a* with the upper end of the pin or at an intersection *5b* with the lower end of the pin so that in a writing implement having offset pairs of cams or helical slots 3 and 4, cams are engaged at their intersections by the upper end of one of the curved pins 8 and 9 and the lower end of the other of said pins, as is apparent from FIG. 1 As a result, if the refill carrier end portions 6 and 7 are identical, one of the curved two-pronged pins 8 and 9 may be used to engage the cams at their upper intersection *5a* and the other curved pin may be used to engage the cams at their lower intersection *5b*. As can be seen, the prongs *8a* and *9a* of the pins are attached to legs, with the legs themselves meeting at an obtuse angle at the approximate vertical center of the pins.

The curved openings 10 and 11 are open at the periphery of the half-cylindrical followers 6 and 7 so that the ends of the pins 8 and 9 can protrude therefrom, and are also open toward the center so that the pins can be inserted, as is apparent from FIG. 1. Each of the half-cylindrical followers 6 and 7 has an inwardly protruding spring tongue 12 and 13, and these tongues slide on the refills in frictional contact. At their forward ends, the refill carriers are provided with conventional sockets 14 and 15 for holding the color refills 16, as is also apparent from FIG. 5.

The intersecting helical slots 3 and 4 consist here of oblique slots, which are cut into the periphery of the sleeve, as is shown in FIGS. 3 and 4, and each oblique slot is provided at each end with a transverse extension 17 for holding the pin in writing position.

The inner sleeve 1 is provided at its rear end with an end cap 18 and a barrel end section 19, which are rotatable relative to the barrel forward section 20, which is to be held in position and is firmly fitted of the writing implement. By such rotation, the two-color refills 16 can be moved to writing and inoperative positions in alternation.

I claim:

1. A dual refill-containing variable refill positioning writing instruments comprising curved cam followers attached to two separate refill carriers and oppositely threaded spiral cam grooves within which said cam followers ride, said writing instrument also including an inner tubular shell having two spiral cam grooves each located around substantially about onehalf circumference of said shell and longitudinally displaced from each other; an outer tubular shell having two spiral cam grooves located around substantially about one-half the circumference of said shell and longitudinally spaced from each other with each of said cam grooves corresponding with but oppositely threaded in respect to said inner shell spiral cam grooves; said writing instrument having one of said curved cam followers located at the intersection of each of the corresponding sets of grooves and said inner shell nesting in and relatively rotatable with respect to said outer shell.

2. The writing instrument of claim 1 in which the intersecting spiral grooves consist of oblique grooves with each groove provided at both ends with transverse extensions for holding the pen in writing position.

3. A dual refill-containing variable refill positioning writing instrument, utilizing cam followers attached to two separate refill carriers, and oppositely threaded spiral cam grooves within which said cam followers ride, said writing instrument comprising an inner tubular cam shell having, two spiral cam grooves, each located around substantially one-half the circumference of said shell and longitudinally displaced from each other, an outer tubular cam shell, having two spiral grooves located around substantially one-half the circumference of said shell and longitudinally spaced from each other, with each of said cam grooves corresponding with, but oppositely threaded, in respect to said inner shell spiral cam grooves, said inner shell nesting in and relatively rotatable with respect to said outer shell, the refill carriers having rear end portions consisting of a half-cylinder with the arc of the half-cylinder resting upon said inner shell, and cam follower pins attached to said rear end portions, said pins extending through said spiral cam grooves of the cam shells, one of said pins being disposed at the intersection of each of the corresponding sets of grooves, with each of said pins having legs joined at an obtuse angle, and two prongs depending from said legs.

4. The instrument of claim 3 in which said pins are positioned so that the upper prong of one pin is engaged in the upper intersection of the inner shell and outer shell cam grooves while the lower end of the second pin is engaged by the lower intersection of the second set of inner and outer cam grooves.

5. The instrument of claim 3 in which the half-cylindrical refill carrier has a hollow portion for easy insertion of the cam follower pin.

6. A dual refill-containing variable refill positioning writing instrument, utilizing cam followers attached to two separate refill carriers, and oppositely threaded spiral cam grooves within which said cam followers ride, said writing instrument comprising an inner tubular cam shell having, two spiral cam grooves, each located around substantially one-half the circumference of said shell and longitudinally displaced from each other, an outer tubular cam shell, having two spiral grooves located around substantially one-half the circumference of said shell and longitudinally spaced from each other, with each of said cam grooves corresponding with, but oppositely threaded, in respect to said inner shell spiral cam grooves, said inner shell nesting in and relatively rotatable with respect to said outer shell, one of said cam followers being disposed at the intersection of each of the corresponding sets of grooves, and an inwardly protruding spring-biased tongue, located on each of the refill carriers, said tongue being in frictional engagement with the opposite refill carrier.

* * * * *